US005970961A

United States Patent [19]

Kotwicki et al.

[11] Patent Number: 5,970,961

[45] Date of Patent: Oct. 26, 1999

[54] VALVE CONTROL METHOD

[75] Inventors: Allan Joseph Kotwicki, Williamsburg; John David Russell, Farmington Hills, both of Mich.

[73] Assignee: Ford Global Technologies, Inc., Dearborn, Mich.

[21] Appl. No.: 09/018,625

[22] Filed: Feb. 4, 1998

[51] Int. Cl.[6] ..... F02M 25/07

[52] U.S. Cl. ..... 123/568.27

[58] Field of Search ..... 123/568.11, 568.16, 123/568.23, 568.24, 568.21, 568.26, 568.27, 90.11; 251/129.1, 129.12, 129.15, 129.17

[56] References Cited

U.S. PATENT DOCUMENTS

| | | | |
|---|---|---|---|
| 3,598,145 | 8/1971 | Wolfson | 137/533.21 |
| 4,172,470 | 10/1979 | Walker | 137/516.29 |
| 4,355,661 | 10/1982 | Mayer | 137/881 |
| 4,409,948 | 10/1983 | Hasegawa et al. | 123/568.27 |
| 4,655,251 | 4/1987 | Nimberger | 137/516.29 |
| 4,662,604 | 5/1987 | Cook | 251/129.17 |
| 5,069,422 | 12/1991 | Kawamura | 123/90.11 |
| 5,375,813 | 12/1994 | Rozinsky | 251/333 |
| 5,460,146 | 10/1995 | Frankenberg | 123/568.21 |
| 5,566,662 | 10/1996 | Messih | 123/674 |
| 5,579,743 | 12/1996 | Kadowaki | 123/568.24 |
| 5,645,019 | 7/1997 | Liang et al. | 123/90.11 |
| 5,669,337 | 9/1997 | Drouillard | 123/41.15 |
| 5,671,705 | 9/1997 | Matsumoto et al. | 123/90.11 |
| 5,701,874 | 12/1997 | Sari et al. | 123/568.26 |

*Primary Examiner*—Willis R. Wolfe
*Attorney, Agent, or Firm*—James J. Dottavio

[57] ABSTRACT

A valve control method for controlling a closed valve position of an exhaust gas recirculation valve for an internal combustion engine includes a feedback correction loop generating a feedback variable by comparing the output of a valve position sensor to a desired closed valve position. The feedback variable is used to control an actuator coupled to the valve which cooperates with a compliant seat. Thus, the desired closed position is maintained in a ready to open state, reducing valve opening delay caused by biasing forces.

14 Claims, 3 Drawing Sheets

VALVE CONTROL METHOD

FIELD OF THE INVENTION

The present invention relates to position control of an exhaust gas recirculation valve for an internal combustion engine.

BACKGROUND OF THE INVENTION

Vacuum actuated valves have long been used in the automotive industry for controlling the flow of various gasses, including exhaust gas recirculation (EGR). EGR systems use the valves as a means for allowing exhaust gas from the exhaust manifold to flow into the intake manifold. Thus, the exhaust gas is recirculated through the engine. Controlling EGR flow is typically used as means for meeting regulated emissions and maximizing fuel economy. Poor EGR flow control can have detrimental effects, such as engine misfires, engine speed surging, and lost fuel economy. In particular, valve opening delay is one aspect of EGR control that has a large effect on the system performance. Opening delay is defined as the time from when an engine control system commands the valve to open and allow EGR flow to the time when the valve actually opens to allow flow. Opening delay results from the preload, or biasing force, commonly used to hold the valve shut. In situations where no EGR flow is required, the preload force holds the valve shut so that disturbances do not accidentally open the valve.

Valve control systems are known in which valve position feedback is used to control the amount of EGR flow. By measuring the position of the valve and using a predetermined map between valve position and flow area, an indication of EGR flow can be obtained. Comparing this estimated EGR flow based on a valve position measurement to a desired EGR flow, a feedback signal is created. The feedback signal is then used to control an actuator to maintain the desired EGR flow. When no EGR flow is required, the biasing force is used to hold the valve closed against disturbance forces caused by exhaust pressure pulsations or engine vibration shaking forces that might tend to open the valve. As previously mentioned, it is necessary to keep the valve closed in certain instances because undesired EGR flow can affect emissions, driveability, and fuel economy. Such a system is disclosed in the U.S. Pat. No. 4,662,604. In addition, many valve designs, such as those used for EGR, are known which use a soft seat or stop to create a soft landing valve seat, for example, to reduce noise and increase sealing.

The inventors herein have recognized numerous disadvantages with the above approaches. One disadvantage is the presence of an opening delay, which is cause by the biasing force used to prevent disturbance forces from opening the valve when no EGR flow is desired. For an actuator to open the valve and allow EGR flow, the actuator must first create a large enough force to cancel the biasing force. Then, any additional force created by the actuator can be used to open the valve. Because actuators cannot be built to instantaneously create a force, without considerable expense and complexity, there is always a finite time delay between an open command and actual valve opening. The root cause of this opening delay is the presence of the necessary biasing force.

SUMMARY OF THE INVENTION

An object of the invention claimed herein is to provide a method to control a valve in a closed position thereby compensating for disturbances, resulting in minimal opening delay.

The above object is achieved, and problems of prior approaches overcome, by a valve position control method for controlling a closed valve position of a valve. The method comprises the steps of selecting a desired valve position within a range of valve closed positions and adjusting an actuation force applied to the valve in response to a feedback variable to maintain the desired closed position within the range of valve closed position. The range of valve closed positions is a range between the point where a valve pintle just contacts a compliant valve seat and the point where the valve pintle has completely compressed the compliant valve seat.

By using the position feedback signal, the desired closed position is maintained. For example, if a constant disturbance force DF is acting on the valve, then by using the position feedback, the actuator must generate a force just larger than DF to maintain the valve in the closed region. Then, when the object is to open the valve, a relatively small opening force is all that is required. Thus, the valve position control system maintains an actuation force just greater than the disturbance forces acting on the valve.

An advantage of the above aspect of the invention is that the opening delay is minimized to a fraction of that which was previously possible while maintaining complete rejection of the disturbance forces.

Another advantage of the above aspect of the invention is that the rapid valve response yields better fuel economy and driveability.

Yet another advantage of the above aspect of the invention is that the rapid valve response yields lower emissions.

Other objects, features and advantages of the present invention will be readily appreciated by the reader of this specification.

BRIEF DESCRIPTION OF THE DRAWINGS

The object and advantages described herein will be more fully understood by reading an example of an embodiment in which the invention is used to advantage, referred to herein as the Description of the Preferred Embodiment, with reference to the drawings wherein.

DETAILED DESCRIPTION OF THE PREFERRED EMBODIMENTS

Figure 1:
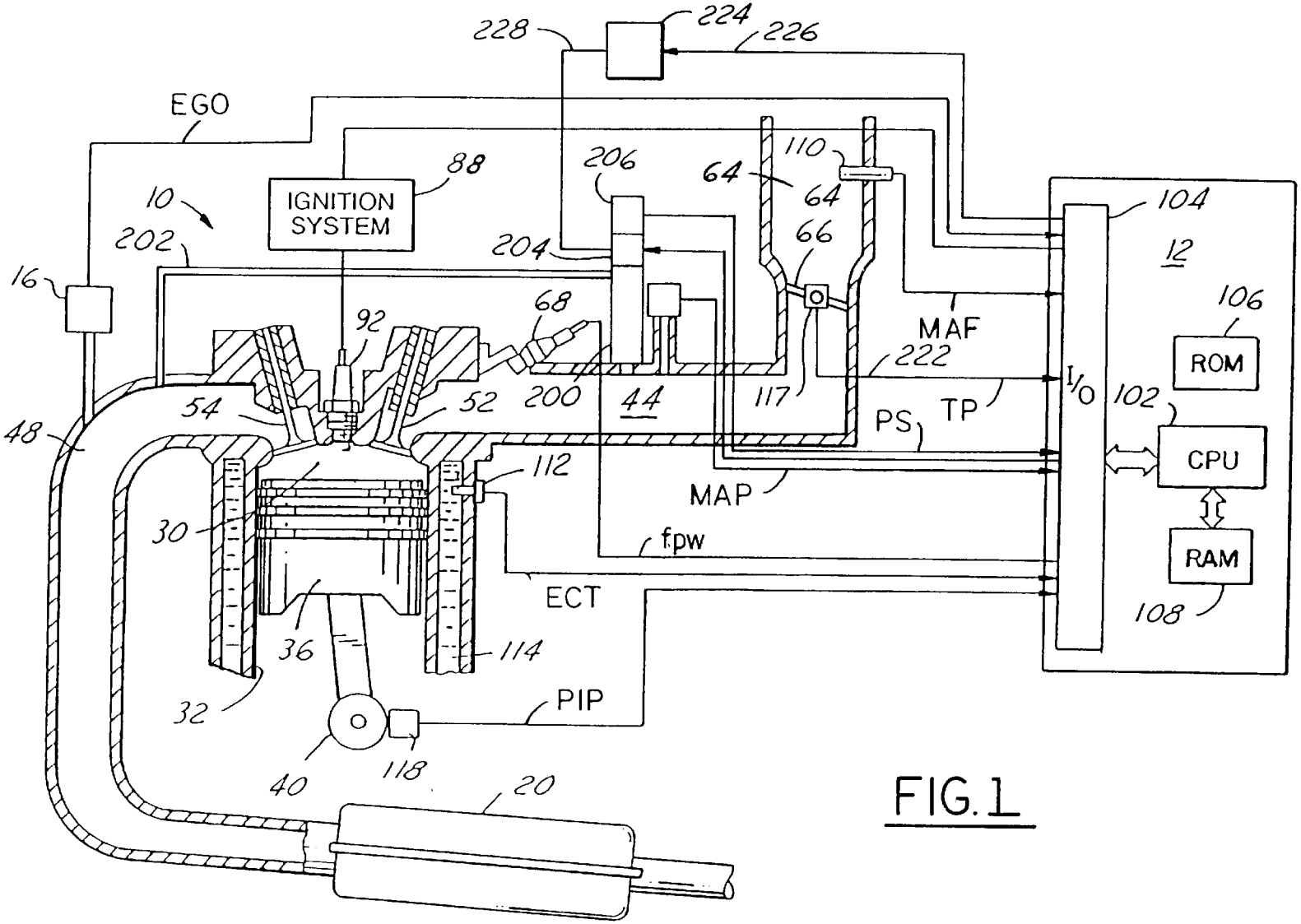
FIG. 1 is a block diagram of an engine in which the invention is used to advantage.

Internal combustion engine 10 comprising a plurality of cylinders, one cylinder of which is shown in FIG. 1, is controlled by electronic engine controller 12. Engine 10 includes combustion chamber 30 and cylinder walls 32 with piston 36 positioned therein and connected to crankshaft 40. Combustion chamber 30 communicates with intake manifold 44 and exhaust manifold 48 via respective intake valve 52 and exhaust valve 54. Exhaust gas oxygen sensor 16 is coupled to exhaust manifold 48 of engine 10 upstream of catalytic converter 20.

Intake manifold 44 communicates with throttle body 64 via throttle plate 66. Intake manifold 44 is also shown having fuel injector 68 coupled thereto for delivering fuel in proportion to the pulse width of signal (fpw) from controller 12. Fuel is delivered to fuel injector 68 by a conventional fuel system (not shown) including a fuel tank, fuel pump, and fuel rail (not shown). Engine 10 further includes conventional distributorless ignition system 88 to provide ignition spark to combustion chamber 30 via spark plug 92 in response to controller 12. In the embodiment described herein, controller 12 is a conventional microcomputer including: microprocessor unit 102, input/output ports 104, electronic memory chip 106, which is an electronically programmable memory in this particular example, random access memory 108, and a conventional data bus.

Controller 12 receives various signals from sensors coupled to engine 10, in addition to those signals previously discussed, including: measurements of inducted mass air flow (MAF) from mass air flow sensor 110 coupled to throttle body 64; engine coolant temperature (ECT) from temperature sensor 112 coupled to cooling jacket 114; a measurement of manifold pressure (MAP) from manifold pressure sensor 116 coupled to intake manifold 44; a measurement of throttle position (TP) from throttle position sensor 117 coupled to throttle plate 66; and a profile ignition pickup signal (PIP) from Hall effect sensor 118 coupled to crankshaft 40.

Intake manifold 44 communicates with exhaust gas recirculation (EGR) valve assembly 200. Exhaust gas is delivered to intake manifold 44 by a conventional EGR tube 202 communicating with both EGR valve assembly 200 and exhaust manifold 48. Vacuum actuator 204 is coupled to EGR valve assembly 200. Vacuum actuator 204 receives vacuum from vacuum source 224 via vacuum tube 228 and vents to the atmosphere (not shown). Vacuum source 224 receives actuation signal (226) from controller 12 for controlling a vacuum level. Potentiometer type position sensor 206, such as those typically used in EGR valves, is coupled to EGR valve assembly 200. Position sensor 206 provides position signal 210 to controller 12 which converts it into a position representative number.

Figure 2:
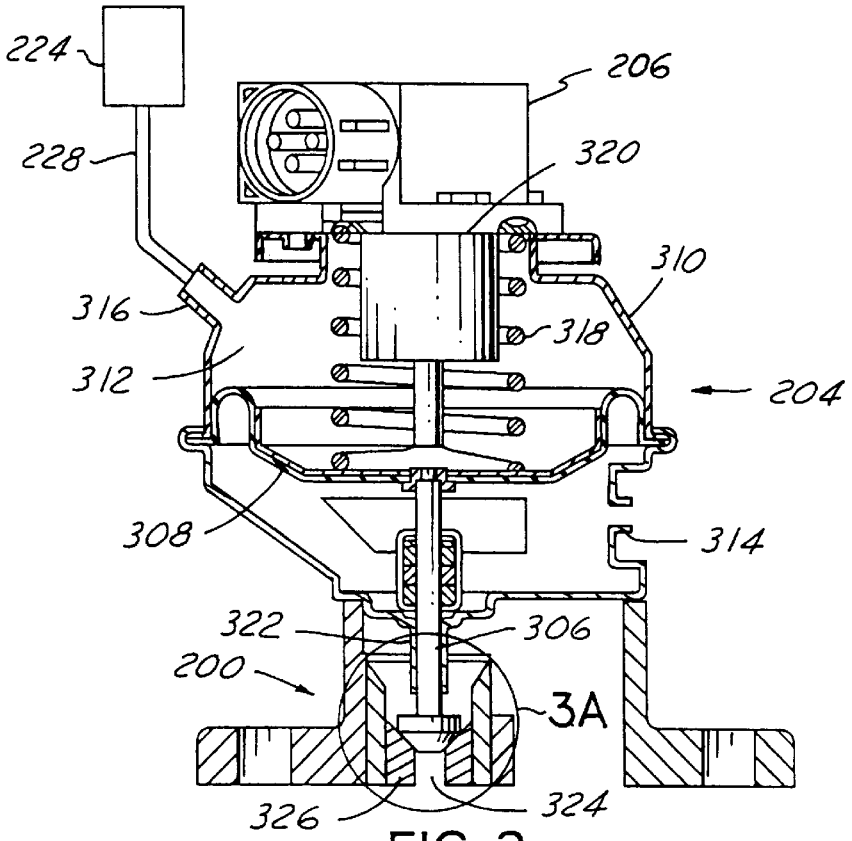
FIG. 2 is a section view of an exhaust gas recirculation valve according to the present invention.

FIGS. 2 and 3 show a section view of EGR valve assembly 200. FIG. 2 specifically shows EGR valve assembly 200, vacuum actuator 206, and valve position sensor 204. Continuing with FIG. 2, pintle 306 is connected to a rubber diaphragm 308. Rubber diaphragm 308 is connected to housing 310, forming an actuation volume 312. Housing 310 has an atmospheric vent 314. Housing 310 also has a vacuum port 316 for allowing actuation volume 312 to communicate with vacuum source 224 via vacuum tube 228. Housing 310 further has measurement hole 320 for allowing position sensor 204 to contact pintle 306. Vacuum source 224 receives a control signal 226 (see FIG. 1) from controller 12. Conventional spring 318 cooperates with pintle 306 and housing 310. Pintle 306 also cooperates with guide 322 for directing motion of pintle 306. Pintle 306 further interferes with EGR flow path 324, either completely, in which case pintle 306 is in contact with compliant seat 326, or minimally, in which case pintle 306 has completely compressed spring 318, or somewhere in between the two. EGR flow path 324 communicates between EGR tube 202 (see FIG. 1) and intake manifold 44 (see FIG. 1).

Alternatively, rubber diaphram 308 could be connected to compliant seat 326 with pintle 306 connected to housing 310, and various other combinations known to those skilled in the art and suggested by this disclosure.

Figure 3A:
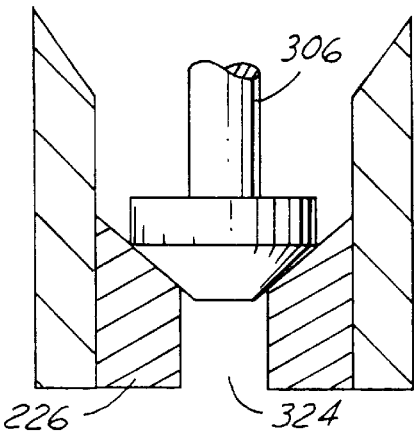
FIGS. 3A and 3B are an enlarged section views of the area encircled by line 3 of FIG. 2 showing ranges of closed positions, respectively.
Figure 3B:
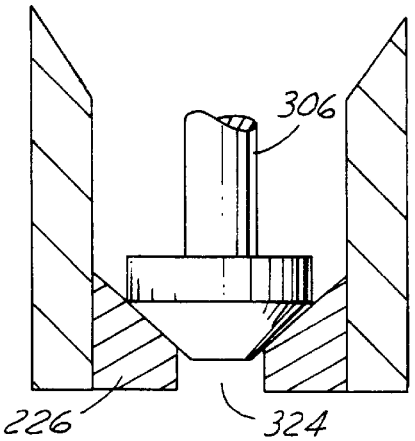

FIGS. 3A and 3B show an enlarged views of pintle 306, EGR flow path 324, and compliant seat 326. FIG. 3A shows pintle 306 in a closed region just touching compliant seat 326, and FIG. 3B shows pintle 306 in a closed region compressing compliant seat 326. According to the present invention, FIG. 3A represents the outermost boundary of the closed region, above which the valve is considered open and some EGR flow is present. FIG. 3B represents the valve in a possible desired closed position. Without compliant seat 326 a range of closed positions would not be possible. The purpose of the compliant seat is to allow position sensor 206 to measure the effect of the disturbance forces, thereby allowing a closed position controller to maintain a desired closed position with minimal opening delay.

Figure 4:
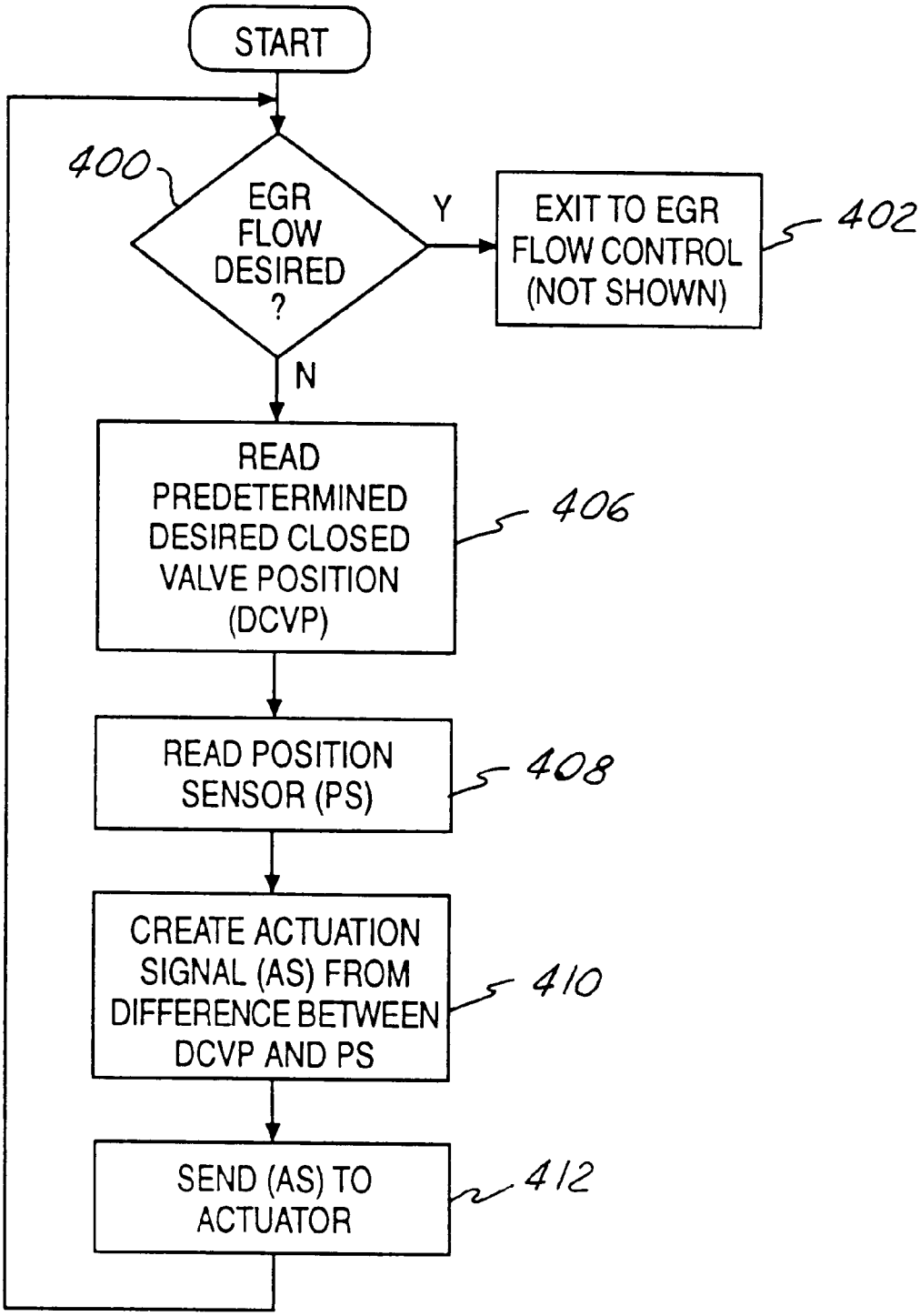
FIG. 4 is a flowchart showing the process performed according to the present invention.

The EGR closed position routine executed by controller 12 for controlling the EGR valve assembly 200 is now described beginning with reference to the flowchart shown in FIG. 4. A determination is made at step 400 whether EGR flow is desired by monitoring engine operating parameters such as TP, MAF, MAP, ECT, and other operating parameters known to those skilled in the art and suggested by this disclosure. If EGR flow is desired, at step 402 the program exits to an EGR flow delivery routine (not shown). The EGR flow delivery routine controls the open position of the valve to regulate the amount of EGR flow delivered to intake manifold 44. If EGR flow is not desired, the desired closed valve position (DCVP) is then read at step 406. At step 408, position sensor value (PS) is then read from position sensor 206. In the embodiment described herein, the position sensor senses the position of pintle 306. Alternatively, the position of pintle 306 may be inferred by, for example, sensing deformation of compliant seat 326, sensing strain in compliant seat 326 or spring 318, and sensing other quantities known to those skilled in the art and suggested by this disclosure. At step 410, actuation signal (AS) is then created from a difference between DCVP and PS. At step 412, AS is then sent as control signal 226. The control signal 226 is received by vacuum source 224, thereby regulating the vacuum level in vacuum actuator 206. The result is a controlled actuation force applied to pintle 306 that cancels disturbances and maintains the desired closed position. The routine is then repeated. By controlling the closed valve position, when EGR flow is desired, the valve is instantly ready to open. The result is a large increase in the quality of EGR flow control. In this way it is possible to maximize the effective use of EGR for reducing regulated emissions and improving fuel economy.

While the best mode for carrying out the invention has been described in detail, those skilled in the art in which this invention relates will recognize various alternative designs and embodiments, including those mentioned above, in practicing the invention that has been defined by the following claims. For example, many different types of position sensors are available for measuring the position of the pintle. Also, there are innumerable ways to provide an actuation force for moving the pintle.

We claim:

1. A valve position control method for controlling a closed valve position of a valve, the method comprising the steps of:

selecting a desired valve position within a range of valve closed positions; and adjusting an actuation force applied to the valve in response to a feedback variable to maintain the desired closed position within the range of valve closed position, the adjusting step comprising the steps of:

reading the feedback variable;

creating an error signal by subtracting the feedback variable from the desired valve position; and generating an actuation signal as a function of the error signal to maintain the desired valve position.

2. The method recited in claim 1, wherein said step of reading the feedback variable comprises the step of measuring valve position.

3. The method recited in claim 1, wherein said step of reading the feedback variable comprises the step of measuring a compliant seat deformation.

4. A valve position control method for controlling a closed valve position of a valve, the method comprising the steps of:

selecting a desired valve position within a range of valve closed positions;

reading a feedback variable;

creating an error signal by subtracting the feedback variable from the desired valve position;

generating an actuation signal as a function of the error signal to maintain the desired valve position.

5. The method recited in claim 4, wherein said step of reading a feedback variable comprises the step of measuring valve position.

6. The method recited in claim 4, wherein said step of reading a feedback variable comprises the step of measuring a compliant seat deformation.

7. The method recited in claim 4 wherein the method further comprises the step of providing an actuation signal to open said valve in response to an exhaust gas recirculation flow command.

8. A valve system for controlling a valve preload force comprising:

a valve comprising:

a compliant member forming a compliant seat;

a valve pintle cooperating with the compliant seat;

a feedback sensor for inferring pintle position;

an actuator coupled to the valve pintle; and a controller for selecting a desired pintle position within a range of valve closed positions, and adjusting an actuation force applied to the valve in response to the inferred pintle position to maintain the desired closed position within the range of valve closed position.

9. The valve control system recited in claim 8, wherein the actuator is coupled to the compliant seat.

10. The valve control system recited in claim 8, wherein the valve is an EGR valve.

11. The valve control system recited in claim 8, wherein the feedback sensor is a pintle position sensor.

12. The valve control system recited in claim 8, wherein the range of valve closed positions is a range between a position where the pintle is contacting the compliant seat without substantially compressing the compliant seat and a position where the pintle substantially compresses the compliant seat.

13. The valve control system recited in claim 8, wherein said controller further creates an error signal by subtracting the inferred pintle position from the desired pintle position and generating an actuation signal as a function of the error signal to maintain the desired pintle position.

14. The valve control system recited in claim 8, wherein said controller further provides an actuation signal to open said pintle in response to an exhaust gas recirculation flow command.

* * * * *